US009266154B2

(12) United States Patent
Gartner et al.

(10) Patent No.: US 9,266,154 B2
(45) Date of Patent: Feb. 23, 2016

(54) FUME EXTRACTION CABINET WITH A WORKING CHAMBER

(75) Inventors: Ulrich Gartner, Grafenberg (DE); Jurgen Liebsch, Linidenberg (DE)

(73) Assignee: Waldner Laboreinrichtungen GmbH & Co. KG, Wangen (DE)

( * ) Notice: Subject to any disclaimer, the term of this patent is extended or adjusted under 35 U.S.C. 154(b) by 1322 days.

(21) Appl. No.: 10/488,780

(22) PCT Filed: Aug. 14, 2002

(86) PCT No.: PCT/EP02/09141

§ 371 (c)(1),
(2), (4) Date: Mar. 5, 2004

(87) PCT Pub. No.: WO03/024631

PCT Pub. Date: Mar. 27, 2003

(65) Prior Publication Data

US 2004/0242143 A1 Dec. 2, 2004

(30) Foreign Application Priority Data

Sep. 18, 2001 (DE) ..... 101 46 000

(51) Int. Cl.
*B08B 15/02* (2006.01)
*B08B 15/00* (2006.01)
*F24F 9/00* (2006.01)

(52) U.S. Cl.
CPC ..... *B08B 15/023* (2013.01); *B08B 2215/003* (2013.01)

(58) Field of Classification Search
USPC ..... 454/56, 188, 61, 55, 49
See application file for complete search history.

(56) References Cited

U.S. PATENT DOCUMENTS 2,649,727 A 8/1953 Snow et al.
2,702,505 A * 2/1955 Nelson ..... 454/62
3,237,548 A 3/1966 Bayern (Continued)

FOREIGN PATENT DOCUMENTS

DE 34 04 775 C1 7/1985
DE 34 31 669 A1 3/1986

(Continued)

OTHER PUBLICATIONS

H. Hilbers, Schadluftabsperrung Durch Raumlufttechnische Systeme, Apr. 1990, pp. 63-68.

(Continued)

*Primary Examiner* — Steven B McAllister
*Assistant Examiner* — Helena Kosanovic
(74) *Attorney, Agent, or Firm* — Roberts Mlotkowski Safran & Cole, PC; David S. Safran

(57) ABSTRACT

A cabinet with a housing, in which a working chamber (3) is located which is open on one side. In order to reduce the risk of a blow-out of harmful substances and in particular to avoid dead-space areas at the internal surfaces of the side walls and the bottom of the working chamber (3), devices are provided which blow in supply-air jets (21, 22) at an acute angle to the internal surfaces of working chamber (3) in such a way that these supply-air jets (21, 22) lie next to the internal surfaces. Furthermore, an upper free jet (18) ensures that light gases, which form in working chamber (3) above this supporting jet (18), are reliably contained in the upper area of the cabinet and cannot contaminate the lower working area.

11 Claims, 6 Drawing Sheets

(56) References Cited

U.S. PATENT DOCUMENTS

| | | | | |
|---|---|---|---|---|
| 3,496,857 | A | 2/1970 | Ellis et al. | |
| 3,747,505 | A | 7/1973 | Turko | |
| 4,280,400 | A * | 7/1981 | Longworth | 454/57 |
| 4,436,022 | A | 3/1984 | Zboralski et al. | |
| 5,042,456 | A | 8/1991 | Cote | |
| 5,167,572 | A | 12/1992 | Etkin | |
| 5,924,920 | A | 7/1999 | DeLuca et al. | |
| 6,089,970 | A | 7/2000 | Feustel | |
| 6,375,562 | B1 * | 4/2002 | Hein | 454/188 |
| 6,739,967 | B2 * | 5/2004 | Saito et al. | 454/61 |

FOREIGN PATENT DOCUMENTS

| | | | |
|---|---|---|---|
| DE | 36 17 821 | A1 | 12/1986 |
| DE | 41 15 602 | A1 | 10/1992 |
| DE | 43 38 382 | A1 | 5/1995 |
| DE | 44 19 268 | A1 | 12/1995 |
| DE | 197 12 975 | A1 | 10/1998 |
| DE | 200 17 731 | U1 | 3/2001 |
| EP | 0 224 034 | A1 | 6/1987 |
| EP | 0 337 469 | A1 | 10/1989 |
| EP | 0 486 971 | A1 | 5/1992 |
| EP | 0 867 665 | A2 | 9/1998 |
| GB | 2 064 100 | A | 6/1981 |
| GB | 2 161 261 | A | 1/1986 |
| GB | 2 336 667 | A | 10/1999 |
| JP | 8-131850 | A | 5/1996 |
| WO | 98/31481 | A1 | 7/1998 |

OTHER PUBLICATIONS

Asecos, Sicherheit Und Umweltschutz, Apr. 2001, pp. 58-59, English IDS Statement of Relevance Attached.

Allan Chen, Energy Efficient Berkeley Fume Hood Cuts Electircity Use in Half, Research News, Berkeley Lab, August 31, 2001, Three Pages.

Allan Chen, Advanced Fume Hood Capable of Immense Savings in Energy Costs, Research News, Berkeley Lab, January 14, 2000, Three Pages.

Geoffrey Bell, Dale Sartor, Evan Mills, High-Performance Laboratory Fume Hood Field Test At the University of California, San Francisco, Final Report for Pacific Gas and Electric Company, Lawrence Berkeley National Laboratory, Lbid-2396, Eetd-Applications Team, October 2001, 44 Pages.

Helmut E. Feustel, Ph.D., Christoper Buchanan, Ph.D., Darryl J. Dickerhoff, Geoffrey C. Bell, Energy-Efficient Fume Hoods (Low-Flowfume Hoods), Lawrence Berkeley National Laboratory, Indoor Environment Department, First Draft, 46 Pages.

* cited by examiner a)

b)

FUME EXTRACTION CABINET WITH A WORKING CHAMBER

BACKGROUND OF THE INVENTION

1. Field of the Invention

The invention relates to a fume extraction cabinet with a working chamber which is open on one side, and which is equipped with an exhaust.

2. Description of Related Art

Cabinets of the initially mentioned type are generally known and can are commercially available. They are subject to certain standards concerning a possible escape (blow-out) of harmful substances.

In this regard, it is known from published German Patent Application DE 19712975 A1 to increase the blow-out safety of a cabinet with a fume extraction working chamber by means of an air curtain which is blown upwards across the opening of the working chamber from the lower side. Although it is thus possible to improve the blow-out safety against disturbances from the exterior, it is not possible to prevent heavy gases, for example, from accumulating at the bottom of the working chamber or light gases from accumulating above the opening of the working space.

SUMMARY OF THE INVENTION

The problem underlying the invention lies in the fact that a fume extraction cabinet with a working chamber of the type mentioned at the outset is designed in such a way that an accumulation of harmful substances at the side walls and the bottom of the working chamber in the housing is avoided.

This problem is solved according to the invention by devices arranged at the open side of the working space, which emit fresh air jets into the interior of the working chamber at an acute angle to the internal surface of the chamber side walls and bottom surface.

A particularly preferred embodiment of the invention is described in greater detail below with the aid of the accompanying drawings.

DETAILED DESCRIPTION OF THE INVENTION

Figure 1:
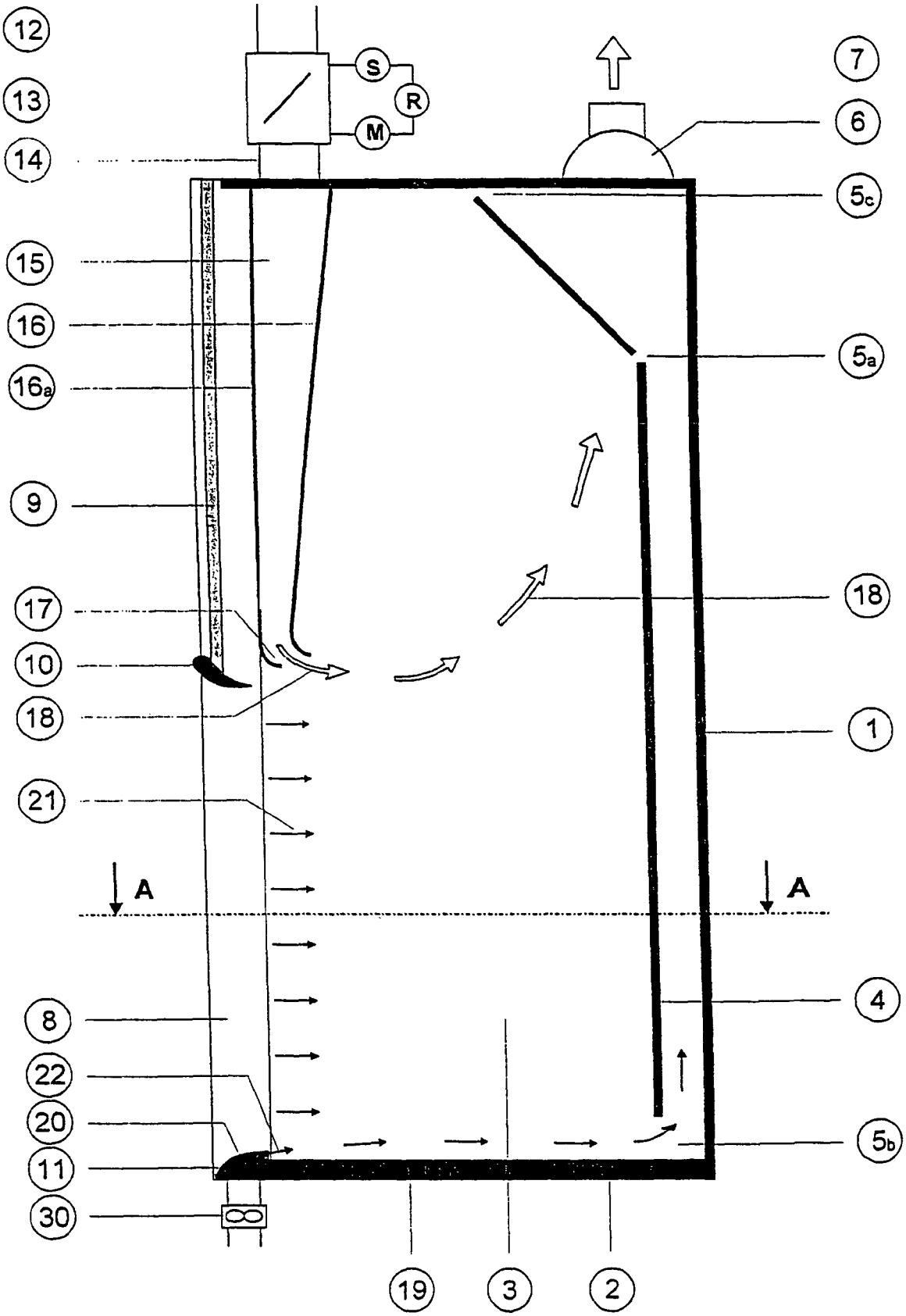
FIG. 1 is a longitudinal sectional view of an embodiment of the invention.

The fume extraction cabinet shown in FIG. 1 comprises a housing 1 with a bottom or a table plate 2, which encloses a working chamber 3 on all sides, except for an opening at one side that is closable by a sliding window 9. A baffle wall 4 runs across the rear wall of the cabinet in working chamber 3. Openings 5*a, b, c, d*, and *e* are provided between the baffle wall 4 and the housing walls and the chamber located behind baffle wall 4 is exhausted via a collecting channel 6 which is connected to an cabinet air system 7.

The side posts of housing 1 of the cabinet are designed as aluminium posts 8 formed for flow-technology purposes, preferably as a profiled part in the manner of an aircraft wing with a leading face pointing forwards, whereby sliding window 9 has an inflow profiled part 10 correspondingly formed for flow-technology purposes. The leading edge of table plate 2 also have an inflow profile 11 formed for flow-technology purposes, which can similarly be a profiled part in the manner of an aircraft wing with a leading face pointing forwards/outwards.

Above the cabinet there is arranged an supply-air pipe 12, from which supply air is blown into the exhaust, i.e., into working chamber 3. This supply air can originate from the external space or from an owner air-supply network. The amounts of air blown in, regulated by a regulator 13 which comprises a differential-pressure or flow sensor, a regulating butterfly valve, a motor and a central electronic control unit, are blown into a distribution collecting channel 14 and introduced into working chamber 3 through a supply air nozzle 15, which is formed by a chamber which is bounded by surface parts 16 and 16*a*. In the lower area of the chamber, which is formed in the manner of a nozzle, there are deflection profiles 17, which guide a free jet 18 inwards into working chamber 3 of the cabinet. The design of the supply air device is described below in detail with the aid of FIG. 5.

As is further shown in FIG. 1, inflow profile 11 at the leading edge of table plate 2 is designed in such a way that, on both sides, an air jet 22 is blown into the housing interior, obliquely at an acute angle relative to the bottom surface in such a way that this air jet 22 is deflected by the inflowing air onto the table plate 2 and passes along the table plate to opening 5*b* between baffle wall 4 and the rear side of the cabinet 1.

The profiled parts of side posts 8 are also designed in such a way that they emit supporting jets 21 into the housing interior, which are also blown at an acute angle relative to the internal surfaces of the side walls of the housing.

Figure 2:
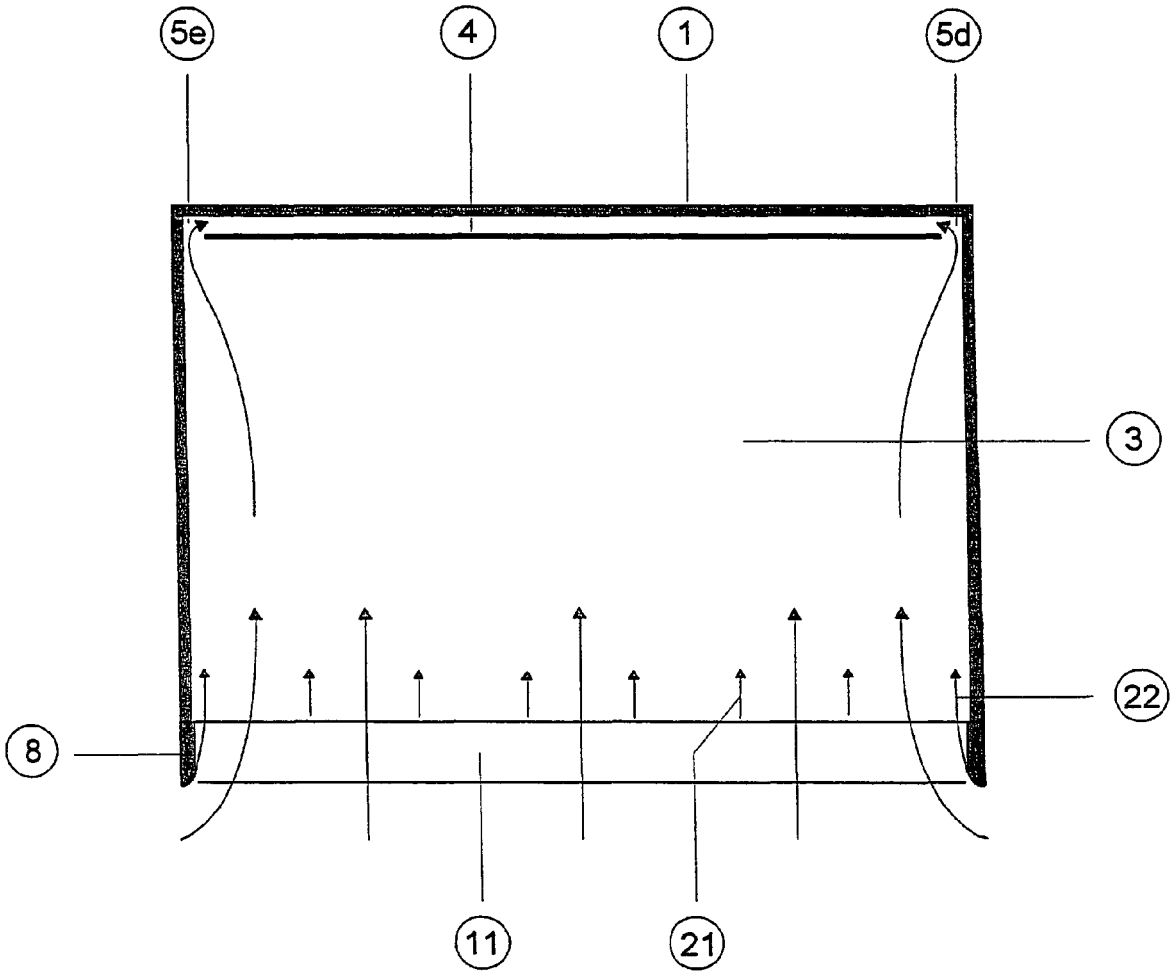
FIG. 2 is a cross-sectional view taken along line A-A of FIG. 1.

FIG. 2 shows the course of air jets 21, 22 in detail. In particular, air jets 22 emerge from the profiled part which forms side posts 8 at an acute angle relative to the internal surfaces of the side walls, which air jets are deflected against the side walls due to the afterflowing air and go into cabinet openings 5*d* and 5*e*. A supply-air curtain formed from a plurality of air jets 21 additionally flows from leading edge profile 11 via table plate 2.

Figure 3:
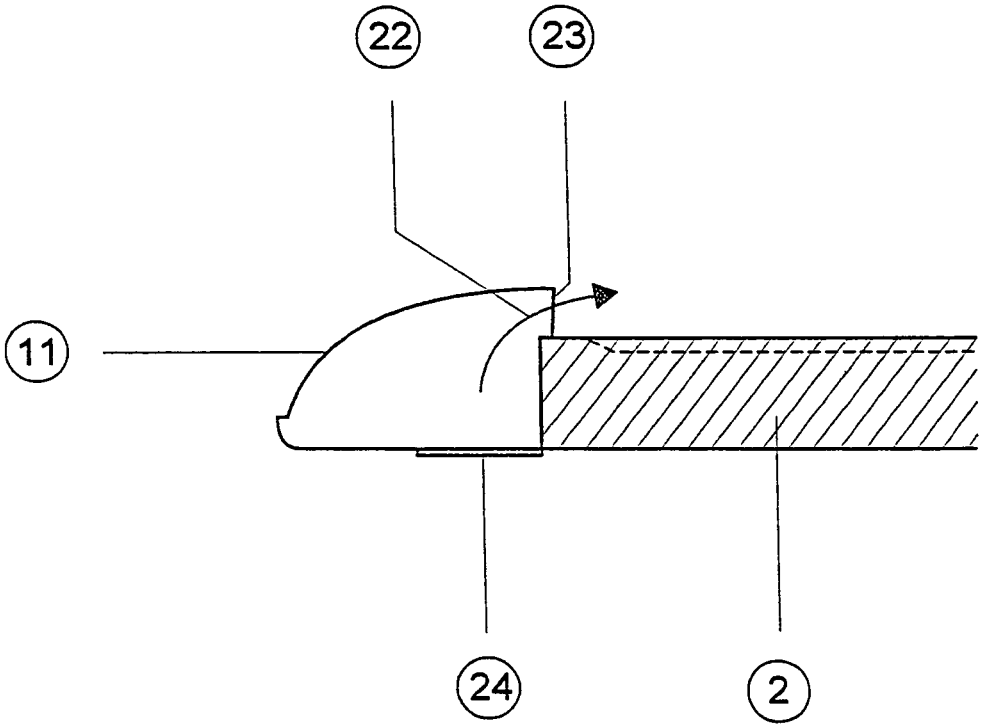
FIG. 3 is an enlarged side view of the leading edge profile of the FIG. 1 embodiment, FIG. 4 a side view of a side post profile of the FIG. 1 embodiment, FIG. 5 show the area of the supply air device of the FIG. 1 embodiment.

FIG. 3 shows table plate 2 and inflow profile 11 at the leading edge of the table plate 2 in detail. In the embodiment shown, profiled part 11 is designed as a hollow section and air flows via an air connection 24 into profiled part 11. This air escapes through milled openings 23, for example, in the form of slots or nozzles, which fit against the surface of table plate 2, in such a way that an air jet 22 is blown into the interior of the cabinet at an acute angle.

Figure 4:
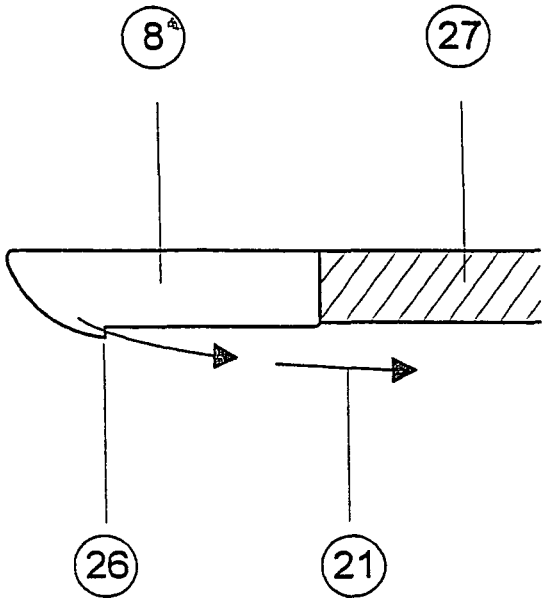

FIG. 4 accordingly shows a profile of side posts 8, which is also designed as a hollow chamber section. Air, which flows at an acute angle into working chamber 3 of the cabinet via an opening or nozzle 26, then fits against the internal surface of side part 27.

The devices for generating the additional air jets 21, 22 can be provided at a distance from the profile leading face or directly behind the profile leading face of profiled parts 8, 11.

Figure 5:
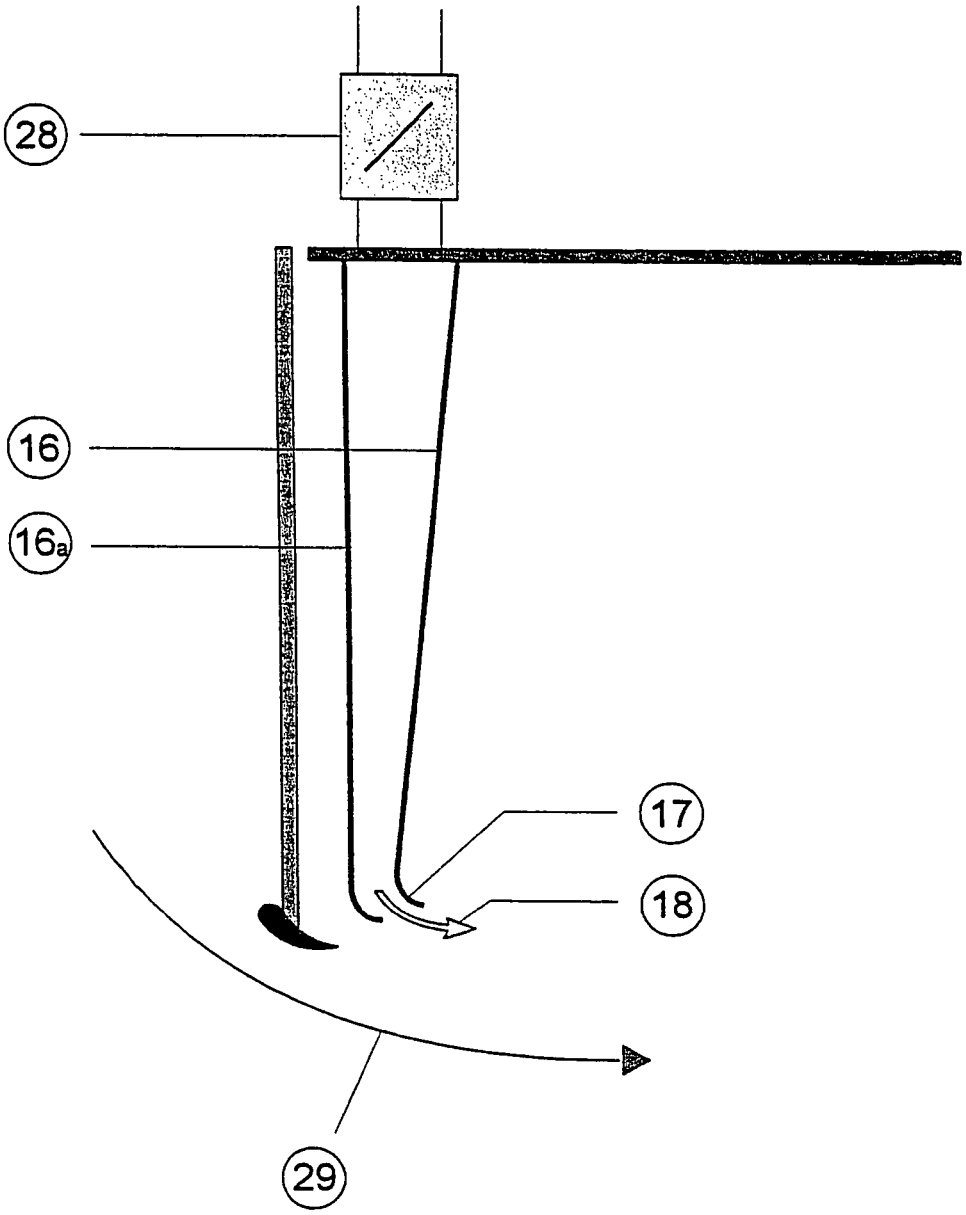

FIG. 5 shows the upper area of the cabinet, and here in particular, the air supply device. As is shown in FIG. 5, the air supply comes via an air supply fan or another fan, is a split up by a pressure chamber 28 and is blown into working chamber 3 of the cabinet as free jet 18 via a nozzle, which comprises the housing sides and the two parts 16 and 16*a* of the chamber already mentioned.

In the lower area of this chamber, i.e., in the lower area of parts 16 and 16*a*, deflection profiles 17 are provided, which are designed such that the free jet from the nozzle is first bent and then deflected inwards, so that, together with the impetus of the air flowing in from the exterior, it flows inwards into working chamber 3 of the cabinet at an angle of 45° to the vertical. This supply air unites with the air flowing in from the exterior into working chamber 3.

Figure 6:
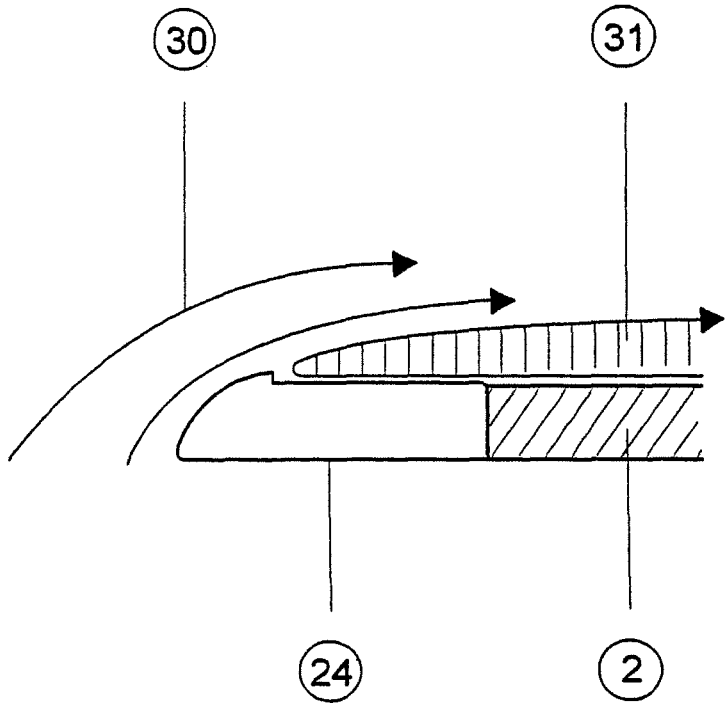
FIG. 6 illustrates the effect of the design according to the invention in terms of reducing the risk of a blow-out of harmful substances.
Figure 6:
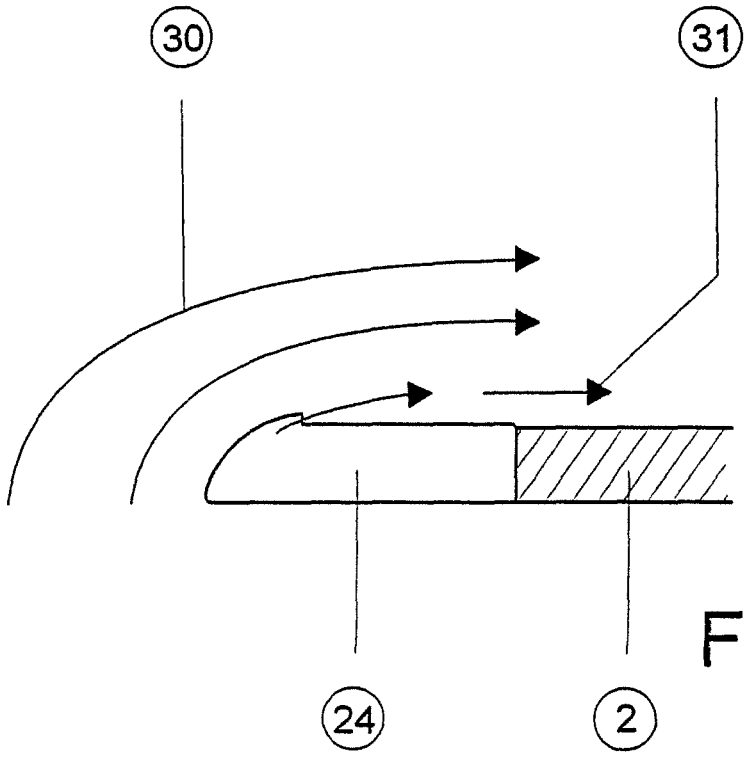

FIG. 6 shows the effect of air jets 22 in detail. The same also applies to air jets 21.

FIG. 6*a* shows that inflowing air 30 fits against the inflow profile at the leading edge of table plate 2 but does not approach the table plate surface, so that a backflow zone 31 arises, into which air from the interior of working chamber 3 of the cabinet flows up to the breakaway edge and in which harmful substances are thus able to accumulate.

As is shown in FIG. 6*b*, due to the force of air 30 flowing into the working chamber 3, an additional air jet 22 flows directly along the surface of table plate 2 until it disappears into openings 5*d* and 5*e*.

When blowing-out of the air jets at the table plate and at the two sides is switched on, wall friction can thus be largely eliminated, so that the air flows inwards over the whole area of working chamber 3 and disappears behind baffle wall 4.

Particularly when working with heavy gases, this design has the advantage that the latter sink to the surface of the table plate and disappear directly at lower extraction opening 5*b* of working chamber 3 via the flow portion directed backwards.

Fresh air also flows around the area of the profile of sliding window 9 due to the inflow of additional air as free jet 18 in the upper area of the cabinet at deflection part 17, so that air cannot escape at the upper edge of sliding window 9 either.

The combination of free jet 18 and wall and bottom jets 21, 22, respectively, thus generates an ideal flow configuration in the exhaust.

Possible ratings of the two side air jets 22 are such that the latter amount to around 15 to 20 $m^3$/h. Lower air jet 21 has an air quantity of 10 $m^3$/h per running metre. The air speed amounts to 2 m per second. The deflection angle of air jets 21, 22 is preferably around 20°, so that the latter flow to the internal surfaces in working chamber 3 at an acute angle. Upper free jet 18, at deflection profile 17, is not directed onto a wall, but is blown in the form of a free jet ahead of the space. Therefore, the upper free jet 18 requires a much higher air quantity of approx. 100 to 150 $m^3$/h per running meter of cabinet width. A cabinet with a width of 1500 mm can therefore manage with a free jet of 150 $m^3$/h and wall jets of approx. 50 to 60 $m^3$/h.

Since such an cabinet can be operated with an air control, it requires 150 $m^3$/h when the sliding window is closed. Preferably, the design is such that, when the sliding window is open, the cabinet sucks out 900 $m^3$/h and all wall and supporting jets are generated.

When sliding window 9 is closed, free jet 18 is switched off at deflection profile 17, so that the cabinet air requirement can be lowered to approx. 150 $m^3$/h when the sliding window is closed. Therefore, it is recommended to operate the cabinet with a control which measures the position of vertical sliding window 9. If vertical sliding window 9 opens by more than 50%, free jet 18 on deflection profile 17 is switched on. The same also applies when the horizontal sliding window of the cabinet is opened by more than 10 to 20 mm. Otherwise, free jet 18 is switched off.

In the case of a cabinet in the night-time operation, wall jets 21, 22 can also be switched off, so that the cabinet can always be operated with a small air quantity depending on the requirement situation, which represents a significant advantage compared with a conventional curtain exhaust. The cabinet air quantity then amounts to 100 $m^3$/h.

Since the supporting jets have a considerable influence on the function of the working chamber, they must be constantly checked and monitored in the course of the necessary monitoring of the function of the cabinet from the air-engineering standpoint. This monitoring can be carried out with a differential pressure sensor in the overpressure area where blowing-in takes place. An alarm occurs in the event of a malfunction.

The example of embodiment of the cabinet according to the invention described above displays a high stability compared with a side or oblique flow, in that a dead-space area is prevented at the cabinet surfaces or at the cabinet slide gates. Furthermore, provision is made for very good extraction of heavy gases, since the latter sink to table plate 2 and are blown by additional air jet 22 into opening 5*b*. If light gases are being worked with in the working chamber, free jet 18, at deflection profile 17, ensures that light gases, which form in working chamber 3 at the top above this supporting jet 18, are reliably contained in the upper area of the cabinet and cannot contaminate the lower working area.

The design according to the invention, in which additional air jets 21, 22, 18 are generated, can be linked to the cabinet control in such a way that the cabinet can be operated with as small an air quantity as possible.

The invention claimed is:

1. A fume extraction cabinet, comprising:

a housing in which a working chamber is located, said working chamber having an opening at a front side and being closed by a rear wall and lateral side walls; and a plurality of air jetting devices providing a means for directing a flow of air inwardly directly from the opening into the working chamber, wherein said air jetting devices are constructed of flow-profiled parts having a hollow section and with a leading end of the flow profile pointing outwards of the working chamber and an open end of the hollow section facing inward and toward the rear wall of the housing, said hollow section of the flow-profiled parts being fluidly connected with a positive pressure air supply providing, in use, pressurized air into the hollow section and out of the open end into the working chamber, wherein at least one of the air jetting devices is positioned at a front edge of the bottom wall and at each of the side walls of the housing, the air jetting devices being configured and oriented in a manner creating, in conjunction with said positive pressure air supply, a flow of pressurized air from the open end of the hollow section into the working chamber at an acute angle relative to and away from internal surfaces of the bottom wall and side walls of the housing, the open end of each hollow section being positioned facing toward a rear wall of the housing in a manner creating a means for causing the flow of pressurized air therefrom to substantially eliminate wall friction with respect to air flowing in the working chamber and enabling air to flow inwards above the walls of working chamber and for enabling the flow of pressurized air to prevent the formation of dead air spaces in which harmful substances can accumulate at the side walls and bottom wall of the working chamber.

2. The fume extraction cabinet according to claim 1, wherein the open end of the hollow sections have an exit angle relative to a neighboring internal surface of the housing of approximately 20°.

3. The fume extraction cabinet according to claim 1, wherein the open end of the hollow sections is slot-shaped and elongated to extend along the length of front edges of the bottom and side walls of the housing bordering the opening.

4. The fume extraction cabinet according to claim 1, wherein the positive pressure air supply comprises a fan located upstream thereof which generates an air quantity of 10 $m^3$/h for the air jet which emits at an acute angle relative to the bottom wall of the housing and 15 to 20 $m^3$/h for the air jets which emit at an acute angle relative to the side walls of the housing.

5. A fume extraction cabinet according to claim 1, further comprising:

a baffle wall which runs in front of a rear wall of the housing in the working chamber and wherein the air jets are sucked in directly between a vertical side edge of the baffle wall and the side walls of the housing.

6. The fume extraction cabinet according to claim 1, further comprising an air control which controls all of the air jets.

7. The fume extraction cabinet according to claim 6, wherein said air control comprises a monitoring device which monitors the blowing-in of supply air by the air jets.

8. Fume extraction cabinet according to claim 1, wherein the flow-profiled parts have an aircraft wing shaped external profile with a leading edge facing in an outward direction.

9. The fume extraction cabinet according to claim 1, wherein a vertical sliding window capable of sliding to a plurality of positions is provided on the opening of the working chamber and wherein an additional air jetting device is arranged parallel to said sliding window at an inner side thereof and has a deflection profile by which a free jet emerging therefrom is directed into the working chamber at an acute angle away from the sliding window.

10. The fume extraction cabinet according to claim 9, wherein said additional air jetting device has a control by which it is switched on and off depending on the position of the sliding window.

11. The fume extraction cabinet according to claim 1, wherein the free jet is formed by a fan from ambient air.

* * * * *